US008807009B2

(12) United States Patent
Diehl

(10) Patent No.: US 8,807,009 B2
(45) Date of Patent: Aug. 19, 2014

(54) CAPACITIVE REACTIVE ARMOR ASSEMBLY

(75) Inventor: Matthew D. Diehl, St. Albans, VT (US)

(73) Assignee: General Dynamics—OTS, Inc., St. Petersburg, FL (US)

( * ) Notice: Subject to any disclaimer, the term of this patent is extended or adjusted under 35 U.S.C. 154(b) by 0 days.

(21) Appl. No.: 13/267,720

(22) Filed: Oct. 6, 2011

(65) Prior Publication Data

US 2013/0087038 A1 Apr. 11, 2013

(51) Int. Cl.
*F41H 5/007* (2006.01)

(52) U.S. Cl.
USPC ..... 89/36.02; 89/36.17

(58) Field of Classification Search
USPC ..... 89/36.02, 902, 36.17; 109/36, 37
See application file for complete search history.

(56) References Cited

U.S. PATENT DOCUMENTS 5,070,764 A * 12/1991 Shevach et al. ..... 89/36.17
5,293,806 A 3/1994 Gonzalez
5,577,432 A * 11/1996 Becker et al. ..... 89/36.17
7,819,050 B1 10/2010 MacDougall
2006/0086243 A1 4/2006 Seo et al.
2010/0149729 A1* 6/2010 Nishioka ..... 361/525
2012/0017754 A1* 1/2012 Joynt ..... 89/36.02

OTHER PUBLICATIONS

PCT International Search Report and Written Opinion for PCT/US2012/032058 mailed on Nov. 30, 2012.

* cited by examiner

*Primary Examiner* — Samir Abdosh
*Assistant Examiner* — John D Cooper
(74) *Attorney, Agent, or Firm* — Ingrassia, Fisher & Lorenz, PC

(57) ABSTRACT

A capacitive reactive armor assembly for shielding a vehicle is disclosed herein. The capacitive reactive armor includes, but is not limited to, a first flyer plate, a second flyer plate, and a capacitor positioned between the first flyer plate and the second flyer plate. The capacitor is configured to store an electric charge and to explosively short circuit when the capacitor is penetrated while the capacitor is electrically charged. The explosive release of energy from the capacitor pushes the first and second flyer plates apart interfering with the penetration of a shaped charge jet or ballistic penetrator.

30 Claims, 13 Drawing Sheets

CAPACITIVE REACTIVE ARMOR ASSEMBLY

TECHNICAL FIELD

The technical field generally relates to armor for vehicles and more particularly relates to a capacitive reactive armor assembly for shielding a vehicle.

BACKGROUND

Explosive reactive armor is well known and has been used for decades to protect tanks, armored personnel carriers, and other military vehicles from penetrating ordnance. Conventional, explosive reactive armor includes a layer of explosive sandwiched between two plates commonly known as flyer plates. The flyer plates are typically made of metal. The explosive reactive armor is mounted to the hull of a vehicle such that one of the flyer plates faces outwardly towards the direction of an anticipated incoming ordnance and the other flyer plate faces inwardly towards the hull of the vehicle. The explosive reactive armor is typically oriented at an oblique angle with respect to the anticipated direction of the incoming ordnance and is mounted such that the flyer plate facing inwardly is spaced apart from the hull of the vehicle.

When an anti-armor weapon, such as a jet formed by an explosive shaped charge, penetrates through the outwardly facing flyer plate and contacts the explosive layer, the explosive layer detonates, propelling the two flyer plates in opposite directions. As the two flyer plates move outwardly from the explosive layer, they are driven across the path of the incoming ordnance. Because the two flyer plates are oriented at an oblique angle with respect to the direction of the incoming ordnance, the incoming ordnance must bore a slot, not a circular hole, through each flyer plate in order to reach the armor of the vehicle's hull. Boring a slot through the two moving metal flyer plates typically consumes the majority, if not the entirety, of the energy of the incoming ordnance leaving little, if any, energy to penetrate the armor of the vehicle's hull.

Although explosive reactive armor has proven its worth many times in combat, the manufacture, delivery, and storage of explosive reactive armor has presented some logistical challenges. Because the explosive layer inside the reactive armor is considered a hazard, there are rather severe restrictions placed on the types of facilities where explosive reactive armor can be manufactured. For instance, explosive reactive armor must be manufactured in specially designed and constructed explosive-resistant manufacturing facilities. There are also severe restrictions and limitations imposed during the transportation of explosive reactive armor. For example, explosive reactive armor may not be placed onboard ships and transported to a theater of operation if those ships are also transporting troops. Additionally, is not permissible to equip tanks, armored personnel carriers, and other vehicles operating in the United States with explosive reactive armor due to the potential hazard it poses to civilians. Accordingly, U.S. troops operating in the United States must train for combat using vehicles that are not equipped with explosive reactive armor. Thus, their training does not simulate actual combat conditions as closely as it could if use of explosive reactive armor on public roads were permitted.

Accordingly, it is desirable to provide an explosive reactive armor assembly that can be manufactured, transported, handled, and used in training without the requirement that extensive precautions be taken. In addition, it is desirable to provide an explosive reactive armor assembly that can selectively be rendered non-explosive. Furthermore, other desirable features and characteristics will become apparent from the subsequent detailed description and the appended claims, taken in conjunction with the accompanying drawings and the foregoing technical field and background.

BRIEF SUMMARY

Various embodiments of a capacitive reactive armor assembly for shielding a vehicle are disclosed herein.

In a first non-limiting embodiment, the capacitive reactive armor includes, but is not limited to, a first flyer plate, a second flyer plate, and a capacitor that is positioned between the first flyer plate and the second flyer plate. The capacitor is configured to store an electric charge and to explosively rupture when the capacitor is penetrated while the capacitor is electrically charged.

In another non-limiting embodiment, the capacitive reactive armor assembly includes, but is not limited to a first flyer plate, a second flyer plate and a capacitor that is positioned between the first flyer plate and the second flyer plate. The capacitor is configured to store an electric charge and to explosively rupture when the capacitor is penetrated while the capacitor is electrically charged. The capacitive reactive armor assembly further includes a passive armor body that is disposed proximate the first flyer plate.

In another non-limiting embodiment, the capacitive reactive armor assembly includes, but is not limited to, a first flyer plate and a second flyer plate and a capacitor positioned between the first flyer plate and the second flyer plate such that the first flyer plate and the second flyer plate are adjacent to the capacitor. The capacitor is configured to store an electric charge. The capacitor is further configured to explosively rupture when the capacitor is penetrated while the capacitor is electrically charged. The capacitor is still further configured to propel the first flyer plate and the second flyer plate across a path of a penetrating projectile when the capacitor explosively ruptures. The capacitive reactive armor assembly further includes a passive armor body that is disposed proximate the first flyer plate. The capacitive reactive armor assembly still further includes a housing that is adapted to be attached to the vehicle. The housing is configured to receive the first flyer plate, the second flyer plate, and the capacitor, to attach the first flyer plate, the second flyer plate and the capacitor to the vehicle, and to support the first flyer plate, the second flyer plate, and the capacitor at a position that is spaced apart from the vehicle.

In another non-limiting embodiment, the capacitive reactive armor assembly includes, but is not limited to, a flyer plate and a capacitor that is positioned between the flyer plate and a hull of the vehicle. The capacitor is configured to store an electric charge and to explosively rupture when the capacitor is penetrated while the capacitor is electrically charged.

BRIEF DESCRIPTION OF THE DRAWINGS

The present invention will hereinafter be described in conjunction with the following drawing figures, wherein like numerals denote like elements.

DETAILED DESCRIPTION

Figure 1:
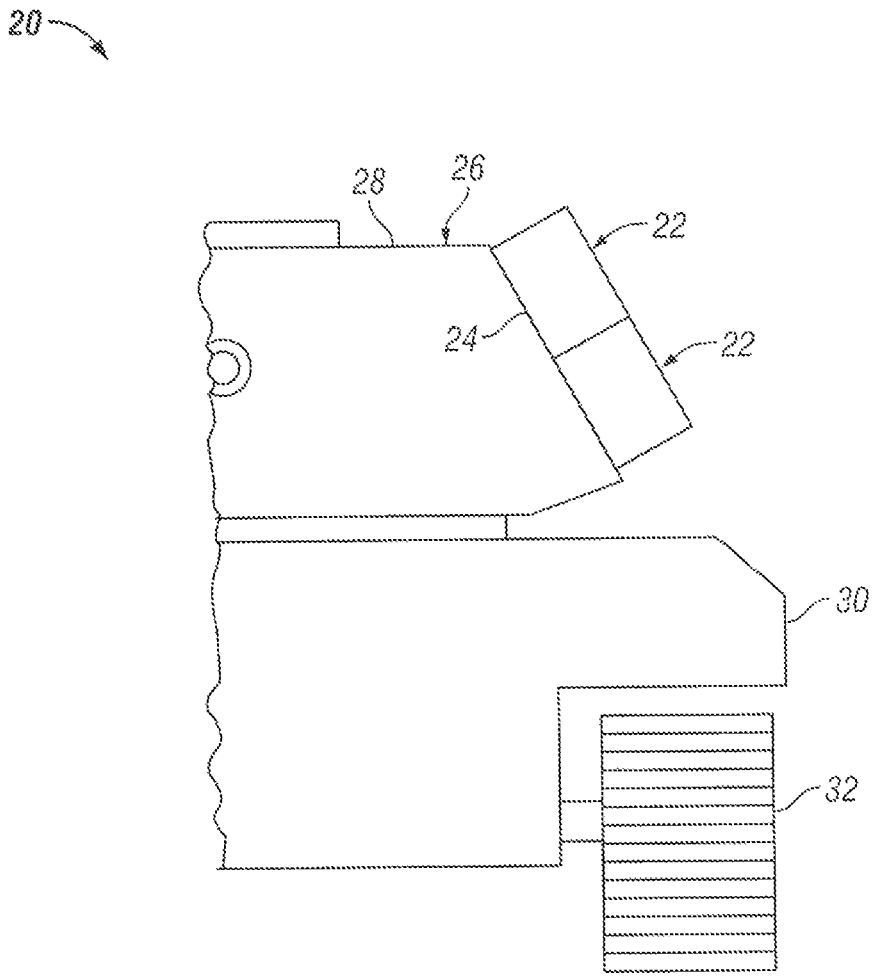
FIG. 1 is a schematic, fragmented view illustrating an armored vehicle equipped with an embodiment of a capacitive reactive armor assembly made in accordance with the teachings of the present disclosure.

The following detailed description is merely exemplary in nature and is not intended to limit the invention or the application and uses of the invention. Furthermore, there is no intention to be bound by any theory presented in the preceding background or the following detailed description.

A capacitive reactive armor assembly is disclosed herein. The capacitive reactive armor assembly of the present disclosure utilizes a capacitor instead of an explosive. Capacitors are known to catastrophically fail under certain circumstances. For example, a capacitor that is electrically charged may catastrophically fail when it is subjected to a voltage or current that is beyond its rating. Such failures can result in arcing of the stored electricity that vaporizes the materials from which the capacitor is constructed. This vaporization can cause the capacitor to rupture and explode. Another circumstance under which a capacitor will catastrophically fail is when the outer casing of the capacitor is physically penetrated while the capacitor is electrically charged. Such penetration causes a short circuit which results in a nearly instantaneous discharge of all electric energy stored in the capacitor. This, in turn, causes the vaporization of the capacitor's internal materials, leading to an explosion.

The present disclosure takes advantage of an electrically charged capacitor's explosive reaction to penetration. In a capacitive reactive armor assembly, a capacitor is positioned next to the flyer plate(s) instead of an explosive material. As used herein, the term "flyer plate" refers to a plate having any suitable configuration and/or shape and which is effective to dissipate the energy of a penetrating ordnance. When the capacitor is penetrated while electrically charged, the capacitor will explode in the manner described above. The explosion will propel the flyer plate(s) across the path of the incoming ordnance dissipating the energy of the incoming ordnance in the same manner as is presently accomplished using conventional explosive reactive armor.

If the capacitor is not electrically charged, then the capacitor will not explode when the capacitor is penetrated. Thus, using a capacitor instead of an explosive as the propellant in a capacitive reactive armor assembly allows the explosive nature of the capacitive reactive armor to be turned on and off at will simply by charging and discharging the capacitor. This ability to turn the explosive capability of the capacitive reactive armor on and off provides many advantages. Because the capacitor is inert when it is discharged, no specialized anti-explosion manufacturing facilities need to be utilized when manufacturing such capacitive reactive armor. Additionally, capacitive reactive armor of the type described herein could be shipped and handled without any special restrictions or precautions simply by discharging the capacitor and rendering the capacitive reactive armor inert. Additionally, vehicles that are configured to be equipped with capacitive reactive armor could be so equipped during training exercises without posing any risk to civilians or property simply by maintaining the capacitors in a discharged condition. This will allow troops operating such vehicles to have a more realistic training experience.

In addition to military applications, there are also civilian uses for capacitive reactive armor of this type as well. For example, the capacitive reactive armor of the present invention may be used to shield spacecraft from micro-meteorites and other particles that may otherwise penetrate a spacecraft and endanger the lives of the crew members inside. Such capacitive reactive armor may also be used to protect structures, such as buildings, monuments, etc. that are considered to be likely targets of terrorist attacks.

A greater understanding of the embodiments of the reactive assembly of the present disclosure may be obtained through a review of the illustrations accompanying this application together with a review of the description that follows.

FIG. 1 is a schematic, fragmented view illustrating a tank 20 equipped with an embodiment of a capacitive reactive armor assembly 22 made in accordance with the teachings of the present disclosure. Although the context of this discussion is with respect to protecting a tank with capacitive reactive armor assembly 22, it should be understood that the capacitive reactive armor assembly 22 may be used in conjunction with any type of war-fighting vehicle including tanks, armored personnel carriers, highly mobile, multi-wheeled vehicles (HMMWV a.k.a. Humvees), military trucks, and the like. Additionally, capacitive reactive armor assembly 22 may also be used with other types of vehicles that are unrelated to war fighting activities. For example, capacitive reactive armor assembly 22 may be used to protect vehicles employed by paramilitary forces, police forces, and other security forces engaged in peacekeeping operations. Furthermore, capacitive reactive armor assembly 22 need not be limited to use with vehicles that are driven on the ground but may also be used to protect aircraft, seagoing vessels and structures. Additionally, although the context of the discussion below relates to protecting a vehicle from a shaped charge jet (i.e., a high velocity jet of metal formed and propelled by the explosive forces of an explosive shaped charge), it should be understood that capacitive reactive armor assembly 22 may also be used to protect the vehicle from other types of ordnance including, but not limited to, explosively formed penetrators, and ballistic projectiles.

In the illustrated embodiment, capacitive reactive armor assembly 22 has been attached to a lateral side 24 of a crew compartment 26 of tank 20. Lateral side 24 may comprise a conventional armor plate that is configured to inhibit intrusion by small arms rounds and small caliber armor piercing bullets into crew compartment 26, but which can nevertheless be penetrated by penetrating ordnance including, but not limited to, a shaped charge jet. Shaped charge jets are conventionally formed by explosive shaped charges which may be launched from a variety of different platforms including, but not limited to, shoulder launched rocket propelled grenades. Shaped charge jets are commonly used to target crew compartments of armored vehicles and are commonly launched from a position and at an angle such that the shaped charge jet will impact lateral side 24 of crew compartment 26. Accordingly, an efficient strategy for utilizing capacitive reactive armor assembly 22 may entail shielding only lateral side 24 of crew compartment 26 with capacitive reactive armor assembly 22, as illustrated in FIG. 1. It should be understood, however, that capacitive reactive armor assembly 22 may be positioned elsewhere on tank 20 including a roof surface 28, an outer surface 30 of tank 20's powertrain and/or an outwardly facing portion of a skirt concealing the treads 32.

Figure 2:
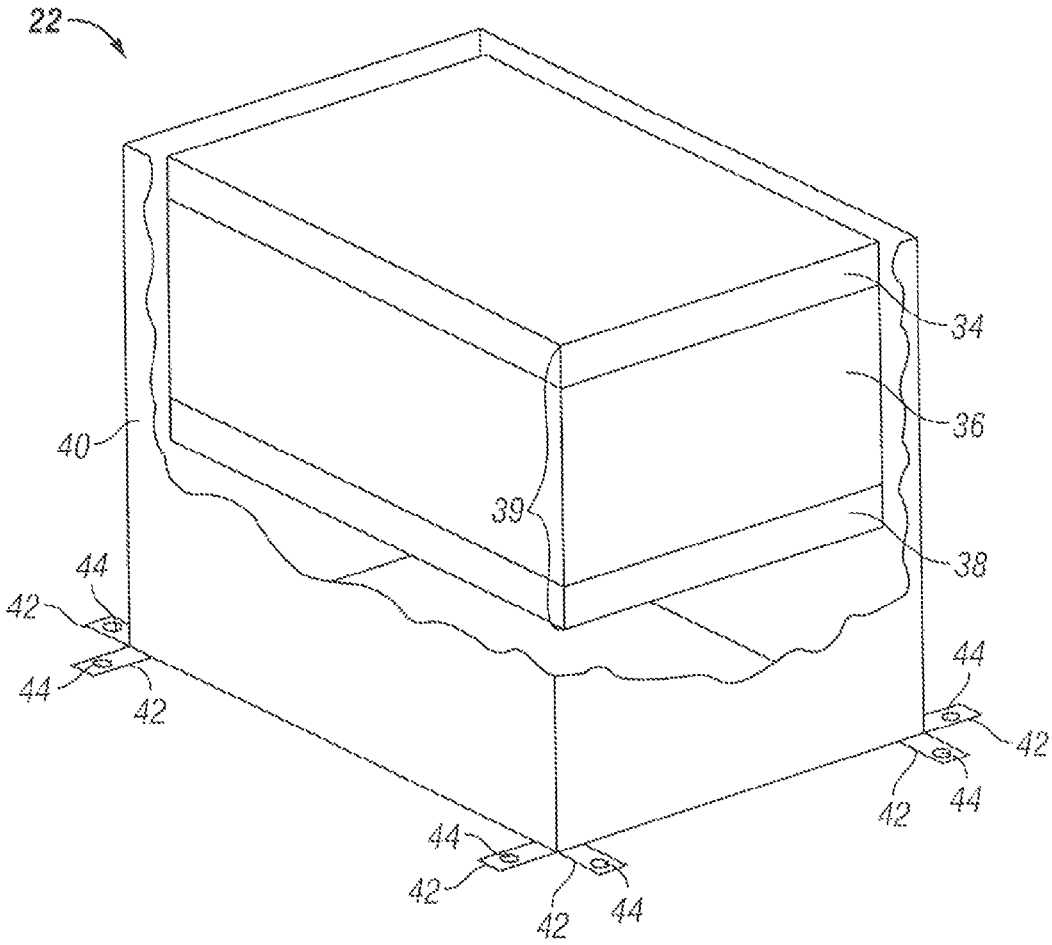
FIG. 2 is a perspective, cutaway view illustrating the capacitive reactive armor assembly of FIG. 1.

FIG. 2 is a perspective, cutaway view illustrating capacitive reactive armor assembly 22. With continuing reference to FIG. 1, capacitive reactive armor assembly 22 includes an outer flyer plate 34 a capacitor 36, an inner flyer plate 38 and a housing 40. Outer flyer plate 34 and inner flyer plate 38 are metal plates that are intended to consume and dissipate the energy of an incoming shaped charge jet or other ordnance by rapidly moving across the path of such ordnance as they are propelled outwardly from capacitor 36 when capacitor 36 explodes. This rapid movement across the path of the incoming ordnance causes the ordnance to bore a slot through the flyer plates instead of merely punching a hole through them as would happen if the flyer plates were stationary. Outer flyer plate 34 and inner flyer plate 38 may be conventional flyer plates such as those currently used on conventional explosive reactive armor or they may be specially designed and configured for use with capacitor-based capacitive reactive armor such as capacitive reactive armor assembly 22. Outer flyer plate 34 and inner flyer plate 38 may be fabricated from any suitable material including, but not limited to, metals, ceramics, composites, elastomers or a combination of any of these materials.

Capacitors are well known in the art and capacitor 36 may comprise any conventional capacitor. In some embodiments, capacitor 36 may be fabricated using materials that have a greater tendency to react with one another when vaporized than are currently used in the fabrication of conventional capacitors. For example, material such as aluminum, zirconium, magnesium, plastics and reactive electrolytes which are known to react more violently. By using materials that react more violently with one another when vaporized, a greater explosive force or a more predictable explosive reaction time or both may be obtained when capacitor 36 is penetrated.

Capacitor 36 may also be designed and constructed in a way that will direct the explosive energy into the flyer plates. For example, the use of a reinforcing perimeter in the capacitor housing or an advantageous orientation of the internal capacitor layers would serve to direct the explosive energy outward into the flyer plates to result in higher separation velocity and improved shaped charge jet defeating characteristics.

Capacitor 36 is sandwiched between outer flyer plate 34 and inner flyer plate 38 and may be attached to the flyer plates using any conventional method including, but not limited to, the use of fasteners, snap-fit features, welded joints, adhesive, or any other method, substance or mechanism that is effective to retain outer flyer plate 34 and inner flyer plate 38 in a position that is adjacent to capacitor 36. For ease of reference herein, the assembly of outer flyer plate 34, capacitor 36, and inner flyer plate 38 shall be referred to as reactive subassembly 39.

Housing 40 houses reactive subassembly 39 and is configured for attachment to tank 20. Housing 40 may be constructed of any suitable material including, but not limited to, metals, composites, ceramics, or any other material effective to support reactive subassembly 39 and further effective to attach reactive subassembly 39 to tank 20. In the illustrated embodiment, housing 40 includes a plurality of flanges 42 having fastener openings 44 that are configured to receive fasteners which may be used to mount housing 40 to tank 20. A threaded fastener or any other type of fastener may be passed through fastener opening 44 and secured directly to tank 20, thereby securing capacitive reactive armor assembly 22 to tank 20.

As illustrated, capacitive reactive armor assembly 22 has been configured to have a three-dimensional rectangular shape. This configuration allows capacitive reactive armor assembly 22 to be placed directly adjacent to other capacitive reactive armor assemblies without leaving gaps between the assemblies. As a result, lateral side 24, or any other surface to which capacitive reactive armor assembly 22 is attached, is protected by a substantially contiguous, uninterrupted protective covering over its entire surface. In other embodiments, capacitive reactive armor assembly 22 may have other geometric configurations without departing from the teachings of the present disclosure.

Although capacitive reactive armor assembly 22 has been illustrated herein as including housing 40, it should be understood that in other embodiments, capacitive reactive armor assembly 22 may omit housing 40. In such embodiments, inner flyer plate 38, capacitor 36, or outer flyer plate 34 may be configured for attachment directly to tank 20 or to another appropriate vehicle without requiring any intervening housing 40.

Figure 3:
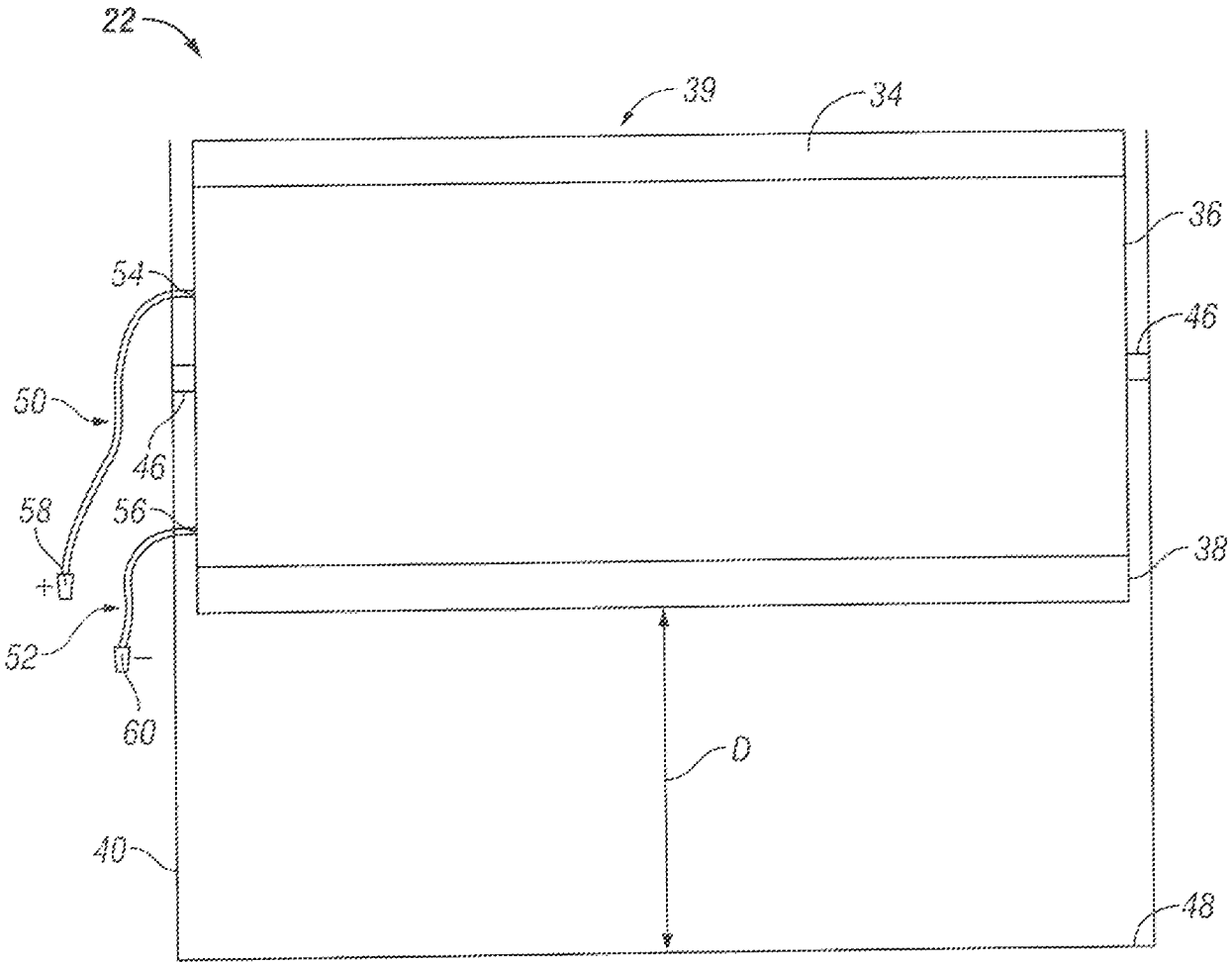
FIG. 3 is a schematic, side view illustrating the capacitive reactive armor assembly of FIG. 1.

FIG. 3 is a schematic, side view illustrating capacitive reactive armor assembly 22. With continuing reference to FIGS. 1-2, explosive subassembly 39 is mounted to housing 40 via mounting pins 46 that lead from housing 40 to capacitor 36. In other embodiments, any method, means, and/or device that is effective to attach subassembly 39 to housing 40 may be used. Inner flyer plate 38 may be separated from a floor surface 48 of housing 40 by a distance D. Distance D may be any suitable, predetermined distance that permits inner flyer plate 38 to move freely towards lateral side 24 of tank 20 when capacitor 36 explodes. The free space provided below the inner flyer plate 38 insures that inner flyer plate 38 will be able to dissipate the energy of an incoming penetrating ordnance as the penetrating ordnance attempts to penetrate inner flyer plate 38.

Also illustrated in FIG. 3 are leads 50 and 52 which are electrically connected at ends 54 and 56, respectively to capacitor 36. Leads 50 and 52 are further configured at ends 58 and 60 for connection to an electrical power source. When ends 58 and 60 are connected to an electrical power source such as a battery or alternator of tank 20, or to any other electrical power source, capacitor 36 may be electrically charged. In some embodiments, bleed-down circuits may be provided to facilitate and control the discharge of stored electrical energy from capacitor 36. In this manner, leads 50 and 52 permit the selective electric charging and electric discharging of capacitor 36 which respectively activates and deactivates the explosive capability of capacitor 36. Configured in this manner, tank 20 is enabled to electrically charge capacitor 36 independently, without requiring the involvement of any external electric power source.

This capability contributes to the combat-readiness of tank 20 which, during combat operations, may be isolated or located remotely from an external electric power source. In some embodiments, capacitor 36 may not only obtain an electric charge from tank 20, but may also be configured to provide an electric charge to tank 20. This may be particularly useful in circumstances where tank 20 has a hybrid electric powertrain. In such circumstances, capacitor 36 may be used as an auxiliary power source to power tank 20. For example, capacitor 36 may facilitate locomotion and/or other operations of tank 20 under circumstances where tank 20 has exhausted its fuel supply or under circumstances where it is otherwise desirable to operate tank 20 using solely an electric component of its hybrid electric powertrain. Such a configuration would give the operators of tank 20 the option to utilize capacitive reactive armor assembly 22 as either a defensive armor or as a spare power source.

Figure 4:
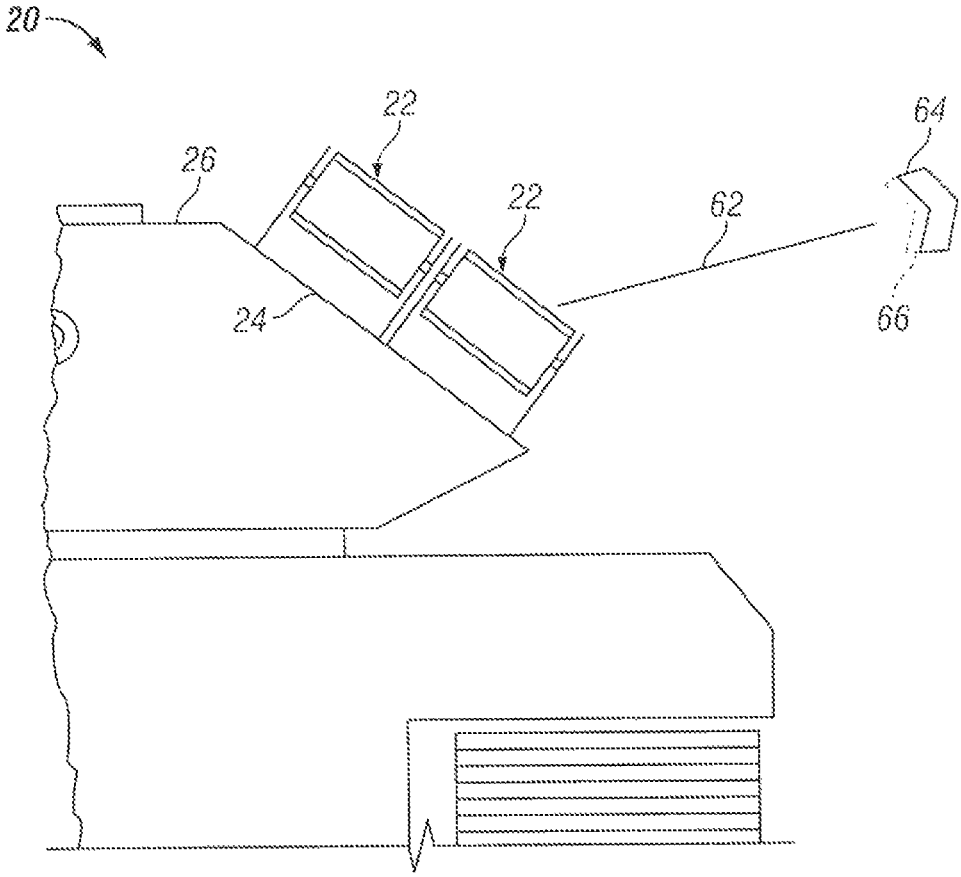
FIG. 4 is a schematic front view illustrating the armored vehicle of FIG. 1 as a shaped charge jet travels towards the capacitive reactive armor assembly.

FIG. 4 is a schematic view of tank 20 as a shaped charge jet 62 moves towards capacitive reactive armor assembly 22. Shaped charge jet 62 is formed during detonation of a shaped charge 64. A layer of metal material 66 (e.g., copper) is overlaid onto shaped charge 64. Shaped charge 64 is configured such that upon detonation, metal material 66 will be compressed by the explosive force of the detonation and formed into a long thin rod of metal material. The long thin rod of metal material, called a shaped charge jet, is propelled by the force of the detonation towards tank 20 at a speed of approximately seven to nine kilometers per second. In the absence of capacitive reactive armor assembly 22, shaped charge jet 62 would puncture the standard armor plating of lateral side 24, enter crew compartment 26, and cause substantial injury to personnel and damage to equipment. As illustrated in FIG. 4, however, tank 20 is equipped with capacitive reactive armor assembly 22 which is positioned between shaped charge jet 62 and a lateral side 24 of tank 20. The sequence of events that will transpire as a shaped charge jet 62 continues traveling towards lateral side 24 will be described below with respect to FIGS. 5-7.

Figure 5:
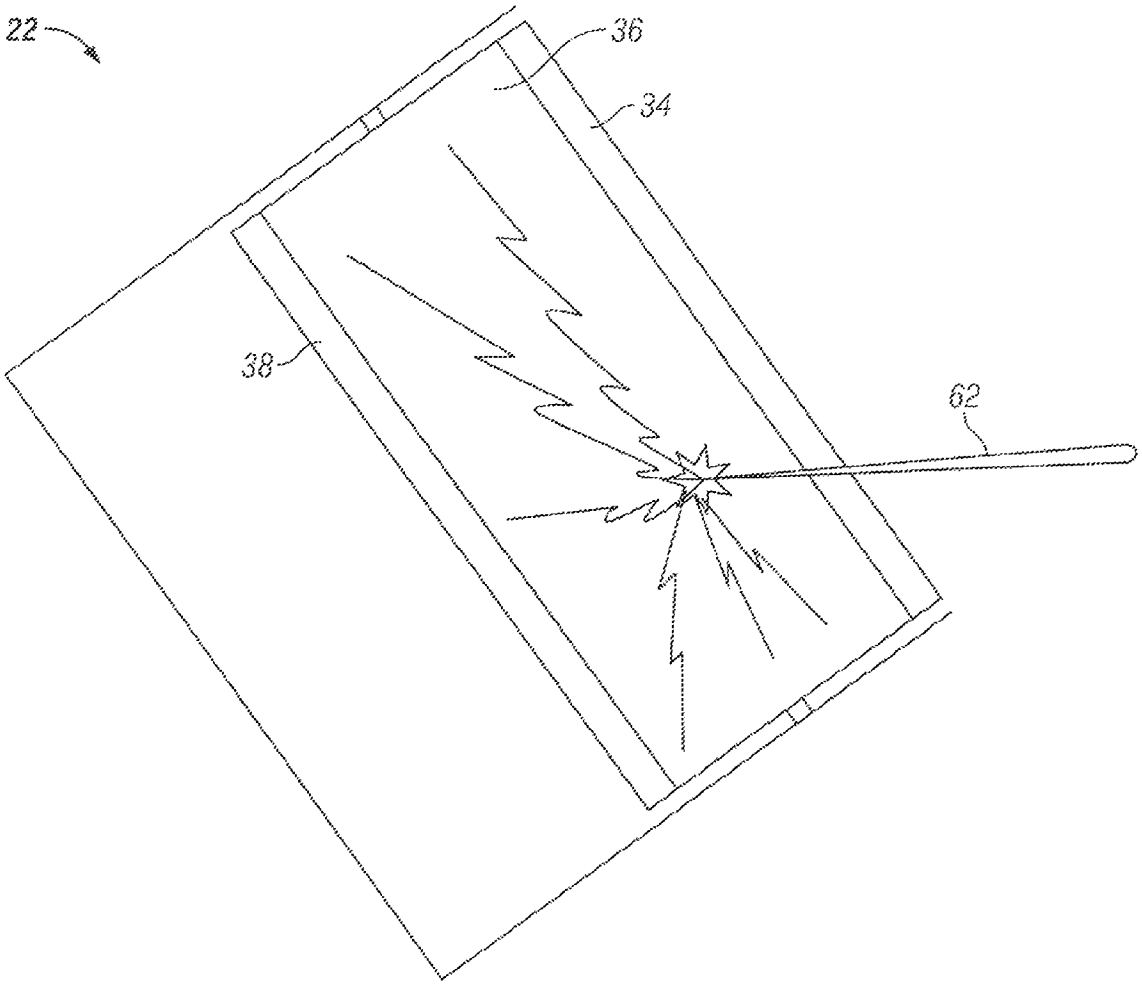
FIG. 5 is schematic side view illustrating the shaped charge jet of FIG. 4 penetrating the capacitive reactive armor assembly of FIG. 1.

FIG. 5 illustrates a shaped charge jet 62 shortly after encountering capacitive reactive armor assembly 22. Shaped charge jet 62 passes through outer flyer plate 34 and punctures capacitor 36. Substantially instantaneous with the puncturing of capacitor 36, a short-circuit occurs within capacitor 36 and all of the electric energy stored in capacitor 36 is discharged into the area damaged by the shaped charge jet 62.

Figure 6:
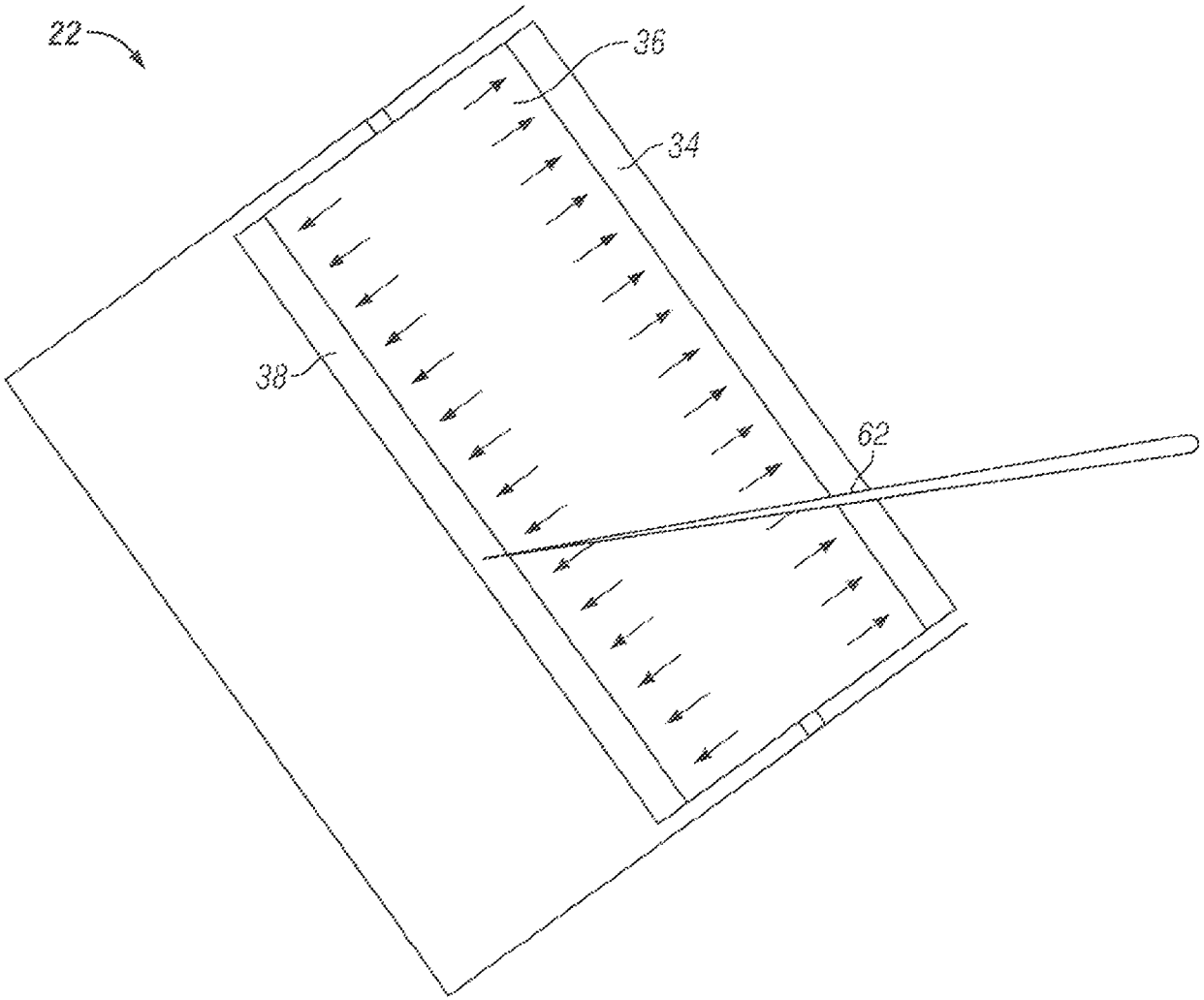
FIG. 6 is a schematic side view illustrating the capacitive reactive armor assembly of FIG. 5 prior to an explosion of a capacitor of the capacitive reactive armor assembly.

FIG. 6 illustrates capacitive reactive armor assembly 22 after capacitor 36 has been punctured and after the electric energy stored in capacitor 36 has been discharged. The discharge of the electric energy stored in capacitor 36 causes the materials inside of capacitor 36 to vaporize. As the materials inside of capacitor 36 vaporize, they rapidly expand. As the vapor expands, it begins to compress against the outer casing of capacitor 36. During this rapid expansion, shaped charge jet 62 continues moving through reactive armor assembly 22.

Figure 7:
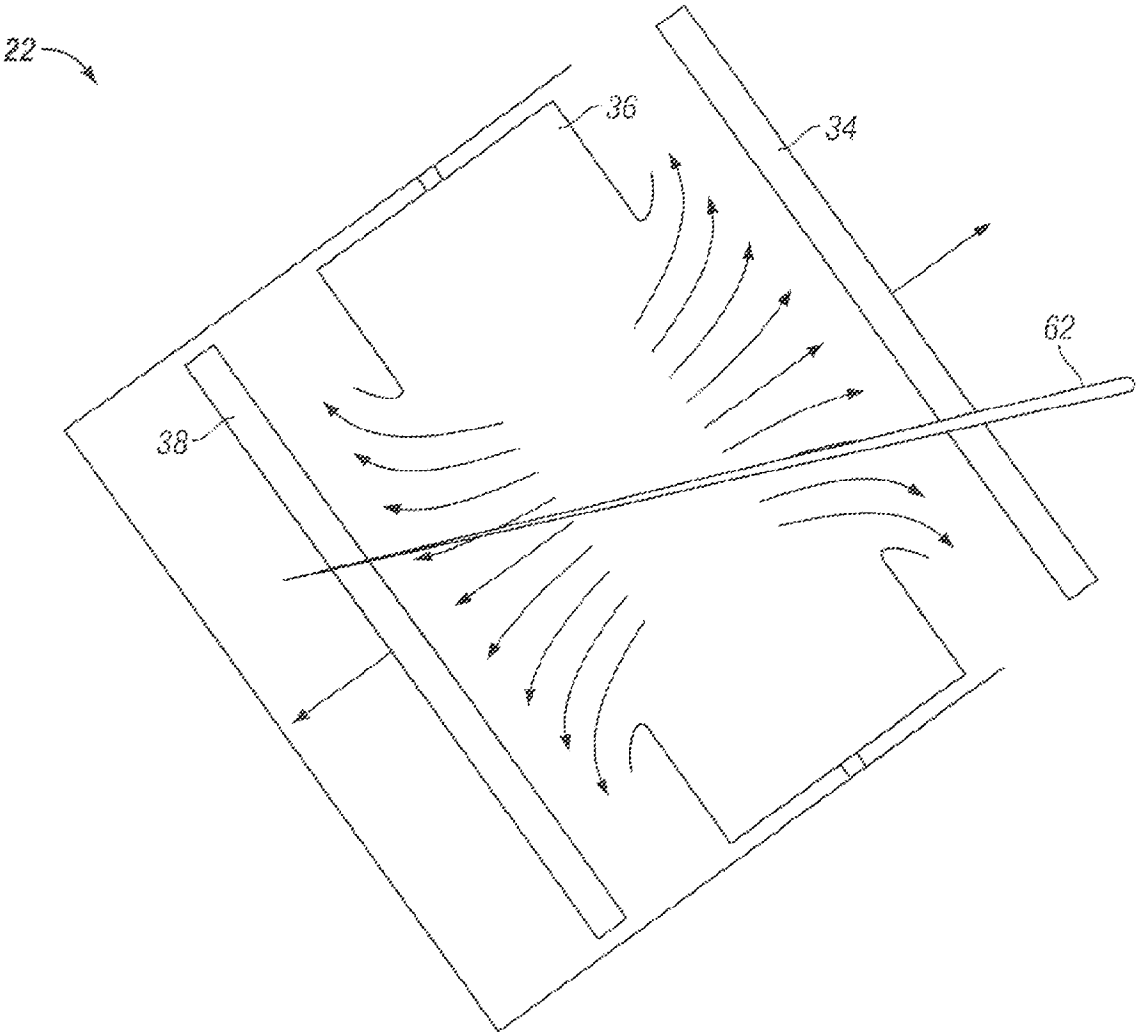
FIG. 7 is a schematic side view illustrating capacitive reactive armor assembly of FIG. 5 subsequent to the explosion of the capacitor.

FIG. 7 illustrates capacitive reactive armor assembly 22 after the rapid expansion of the vapor inside of capacitor 36 causes the outer casing of capacitor 36 to rupture. With continuing reference to FIGS. 1-6, as the outer casing ruptures, the rapidly expanding vapor escapes from openings in the ruptured casing which, in turn, drives outer flyer plate 34 and inner flyer plate 38 in opposite directions. The movement of the outer flyer plate 34 and inner flyer plate 38 in opposite directions causes outer flyer plate 34 and inner flyer plate 38 to rapidly move across the path of shaped charge jet 62 as it attempts to penetrate reactive armor assembly 22. This movement of outer flyer plate 34 and inner flyer plate 38 across the path of shaped charge jet 62 causes shaped charge jet 62 to be obstructed by a continuously moving wall of material. This, in turn, requires shaped charge jet 62 to bore a slot through both outer flyer plate 34 and inner flyer plate 38. Boring a slot through the flyer plates requires much more energy than would be required to simply puncture a hole in each plate. As a result, the kinetic energy of shaped charge jet 62 moving downfield is substantially consumed by outer flyer plate 34 and inner flyer plate 38, rendering shaped charge jet 62 incapable of penetrating the standard armor of lateral side 24 of tank 20.

Figure 8:
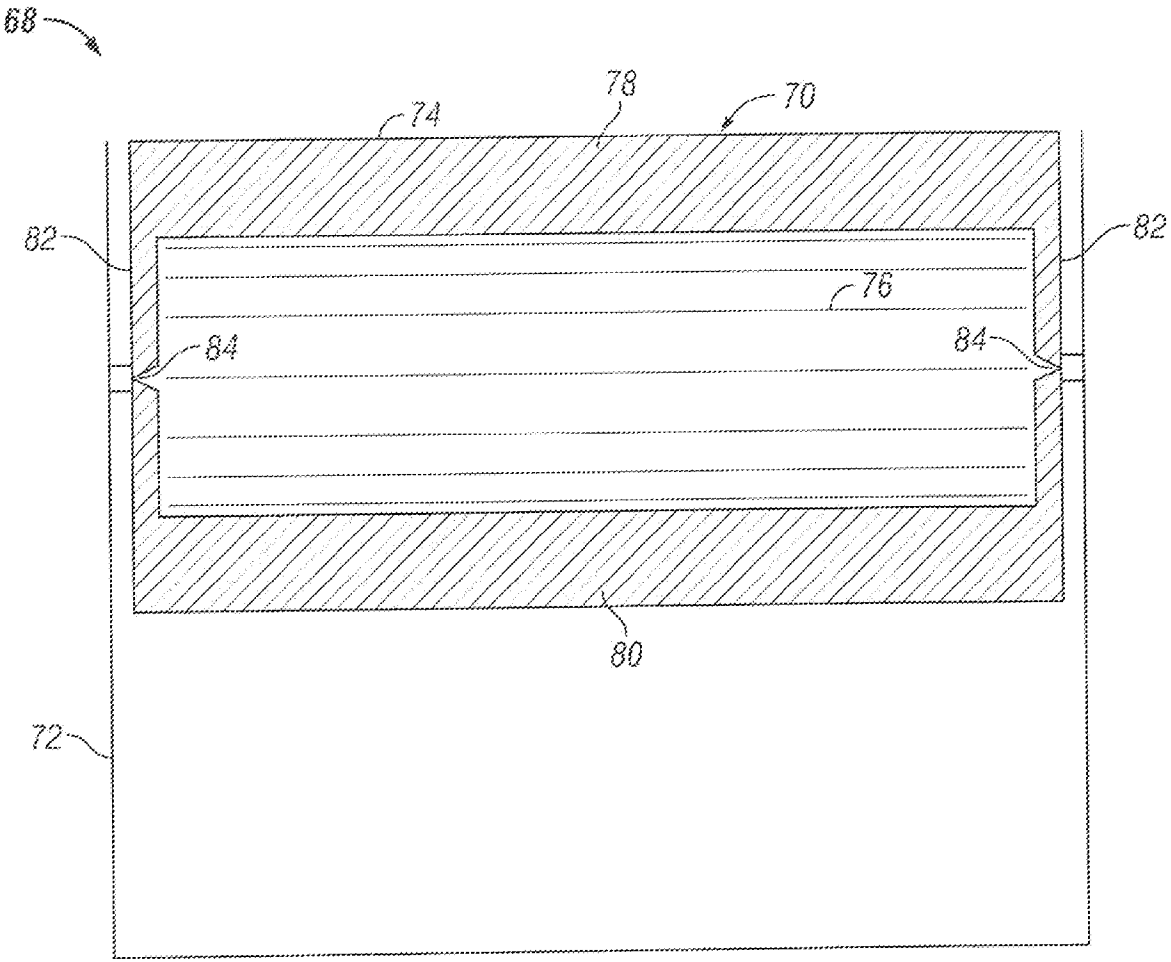
FIG. 8 is a schematic cross-sectional view illustrating an alternate embodiment of a capacitive reactive armor assembly made in accordance with the teachings of the present disclosure.

FIG. 8 is a schematic cross-sectional view illustrating an alternate embodiment 68 of a capacitive reactive armor assembly made in accordance with the teachings of the present disclosure. Alternate embodiment 68 includes a capacitor 70 and housing 72. With continuing reference to FIGS. 1-7, housing 72 substantially identical to housing 40.

Capacitor 70 includes an outer casing 74 substantially enclosing material 76 that is configured to store an electric charge in a manner well known in the art. Outer casing 74 includes an outwardly facing wall 78 that is intended to face an incoming penetrating ordnance and an inwardly facing wall 80 that is intended to face away from an incoming penetrating ordnance. Outwardly facing wall 78 and inwardly facing wall 80 are configured to have a greater thickness than lateral walls 82 of capacitor 70 and a greater thickness than the outer facing walls of a conventional capacitor. By providing outwardly facing wall 78 and inwardly facing wall 80 with an enlarged thickness, outer flyer plate 34 and an inner flyer plate 38 can be omitted. In their stead, outwardly facing wall 78 and inwardly facing wall 80 serve as flyer plates and will dissipate the energy of an incoming penetrating ordnance when the penetrating ordnance causes capacitor 70 to explode.

In some embodiments, such as the one illustrated in FIG. 8, capacitor 70 may include one or more weakened portions 84. In the illustrated embodiment, weakened portions 84 comprise a localized thinning of lateral walls 82. In other embodiments, weakened portion 84 may have any other configuration known in the art for weakening a contiguous material and thereby controlling the location where such material will rupture. When capacitor 70 is penetrated by a penetrating ordnance that causes materials 76 to vaporize and, in turn, cause capacitor 70 to rupture, the rupturing of outer casing 74 will occur at weakened portion 84. This is because weakened portion 84 will provide the least resistance to the forces exerted by the expanding vaporized material 76. The location of weakened portion 84 depicted in FIG. 8 is exemplary and is not intended to be limiting. In other embodiments, weakened portion 84 may be positioned elsewhere in capacitor 70. In still other embodiments, capacitor 70 may include several additional weakened portions 84 at locations suitable for controlling the rupturing of capacitor 70 and the movement of outwardly facing wall 78 and inwardly facing wall 80.

Figure 9:
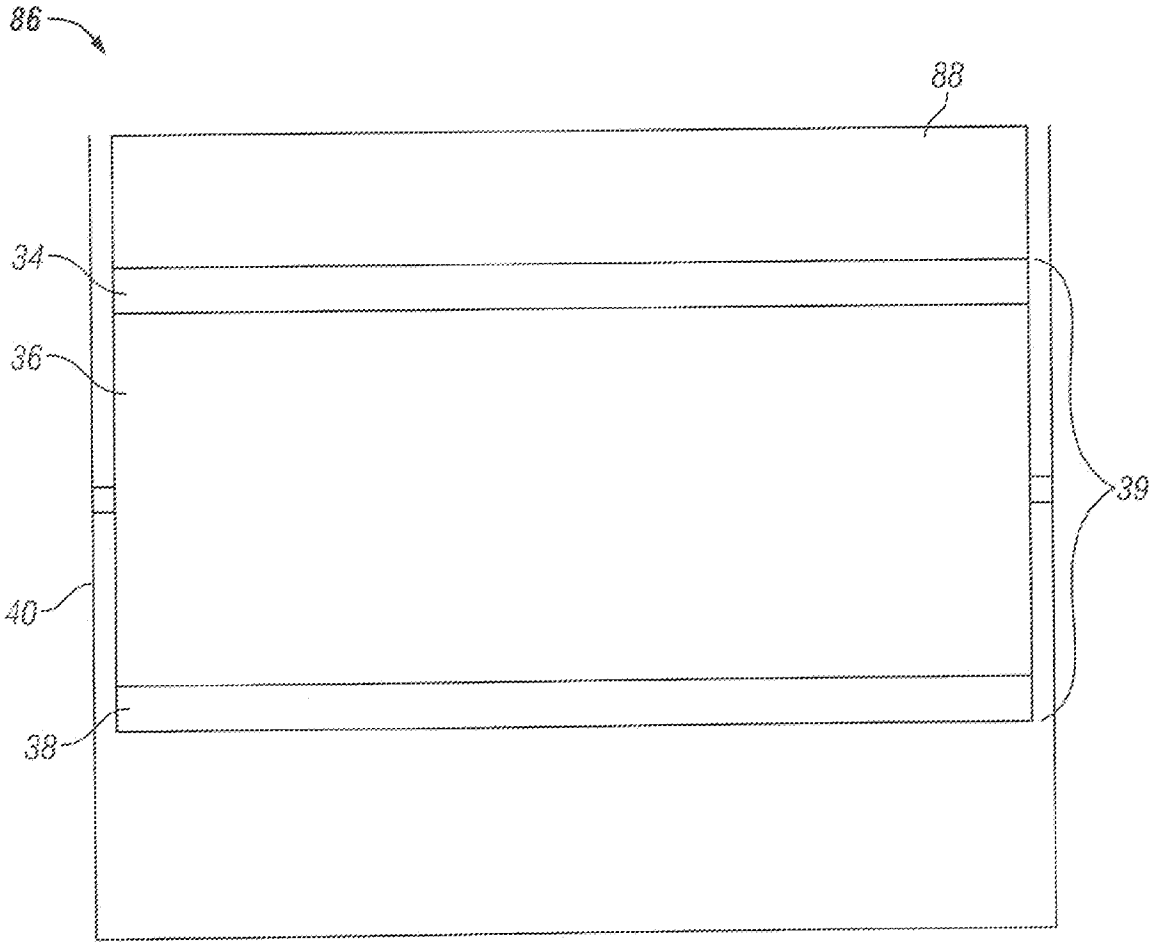
FIG. 9 is a schematic side view illustrating another alternate embodiment of a capacitive reactive armor assembly made in accordance with the teachings of the present disclosure.

FIG. 9 is a schematic side view illustrating another alternate embodiment 86 of a capacitive reactive armor assembly made in accordance with the teachings of the present disclosure. With continuing reference to FIGS. 1-7, alternate embodiment 86 is substantially identical to capacitive reactive armor assembly 22. The primary difference between alternate embodiment 86 and capacitive reactive armor assembly 22 is the addition of a passive armor plate 88 positioned adjacent outer flyer plate 34. Passive armor plate 88 is configured to be more resistant to penetration than outer flyer plate 34 and may comprise any conventional armor plating that is effective to repel non-armor penetrating projectiles such as small arms rounds, shrapnel, grenade fragments, and the like. In some embodiments, passive armor plate 88 may comprise a metal material. In other embodiments, passive armor plate 88 may comprise a composite material. In other embodiments, passive armor plate 88 may comprise a ceramic material. In still other embodiments, passive armor plate 88 may comprise combinations of these materials.

As a result of its elevated level of resistance to penetration, passive armor plate 88 can inhibit small arms rounds and similar projectiles from penetrating through outer flyer plate 34 and capacitor 36. By doing so, passive armor plate 88 inhibits capacitor 36 from exploding when small arms rounds or other similar sized and/or non-penetrating projectiles encounter embodiment 86. Accordingly, alternate embodiment 86 is protected against unnecessary reaction and thus will remain available in a combat environment to defend against penetrating ordnances such as a shaped charge jet even after being struck by bullets and other similarly sized projectiles.

Figure 10:
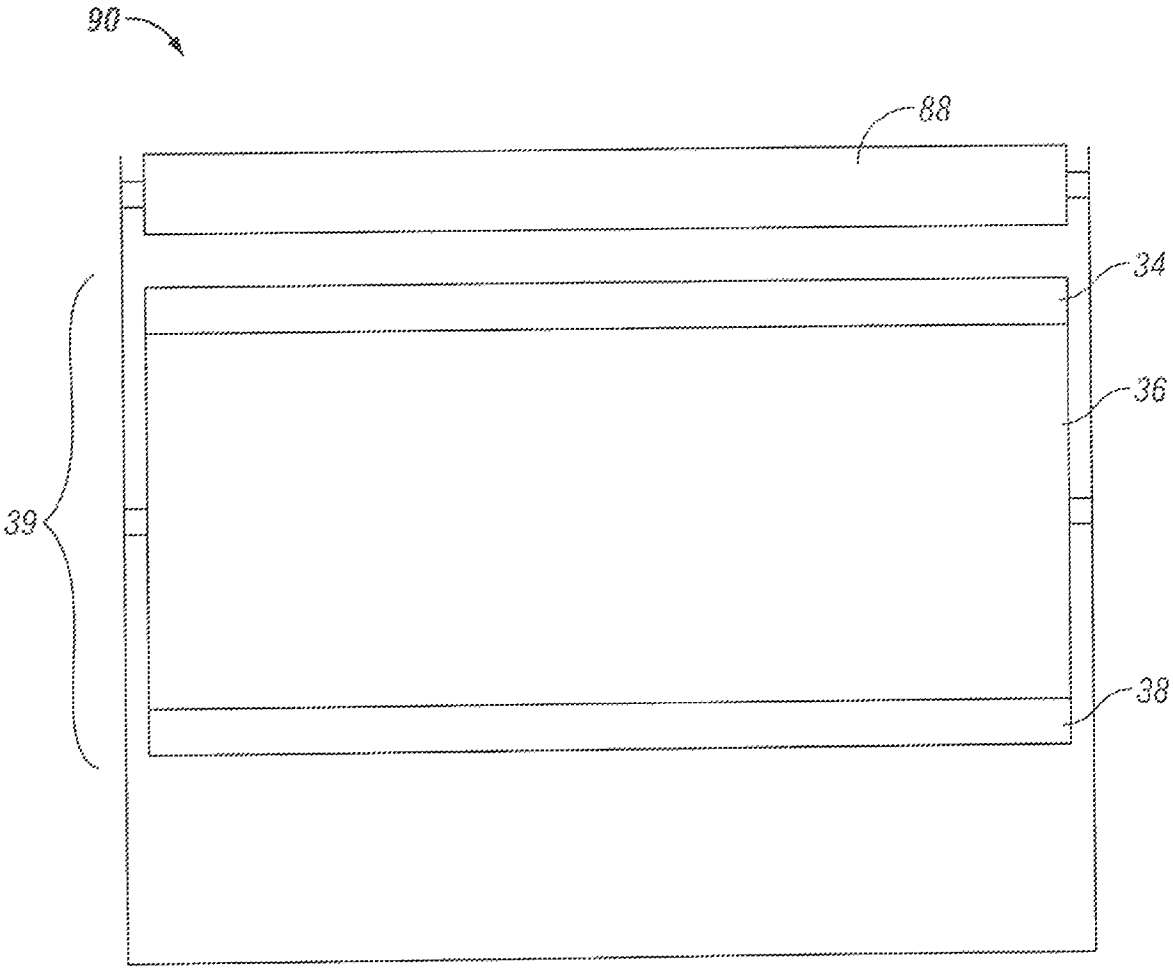
FIG. 10 is a schematic side view illustrating another alternate embodiment of a capacitive reactive armor assembly made in accordance with the teachings of the present disclosure.

FIG. 10 is a schematic side view illustrating another alternate embodiment 90 of a capacitive reactive armor assembly made in accordance with the teachings of the present disclosure. With continuing reference to FIG. 9, alternate embodiment 90 is substantially identical to embodiment 86. The primary distinction between alternate embodiment 90 and alternate embodiment 86 is that alternate embodiment 90 spaces passive armor plate 88 apart from outer flyer plate 34. This arrangement minimizes any disturbance experienced by reactive subassembly 39 when incoming small arms rounds and other similarly sized fragments are repelled by passive armor plate 88 by isolating subassembly 39 from passive armor plate 88.

Figure 11:
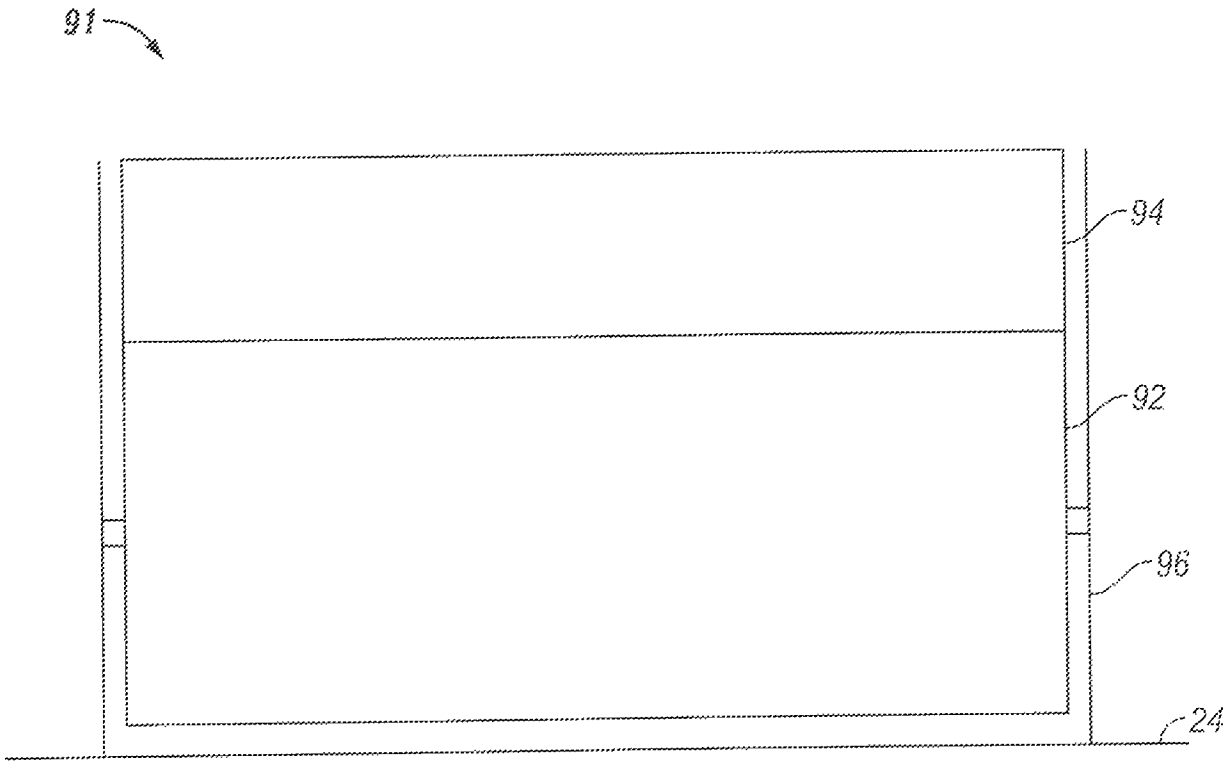
FIG. 11 is a schematic side view illustrating another alternate embodiment of a capacitive reactive armor assembly made in accordance with the teachings of the present disclosure.

FIG. 11 is a schematic cross-sectional view illustrating an alternate embodiment 91 of a capacitive reactive armor assembly made in accordance with the teachings of the present disclosure. Alternate embodiment 91 includes a capacitor 92, a flyer plate 94, and a housing 96. With continuing reference to FIGS. 1-10, housing 96 is substantially identical to housing 40, capacitor 92 is substantially identical to capacitor 36, and flyer plate 94 is substantially identical to outer flyer plate 34, but may include passive armor 88 as an assembly.

Alternate embodiment 91 differs from capacitive reactive armor 22 primarily in that alternate embodiment 91 includes only a single flyer plate disposed on an outboard side of a capacitor whereas capacitive reactive armor 22 included a pair of flyer plates and a capacitor sandwiched therebetween. The advantage of the design that utilizes only a single flyer plate is that such a design reduces the number of components comprising the assembly. This, in turn, simplifies the manufacture of alternate embodiment 91, and may also reduce its cost.

When a penetrating ordnance pierces through flyer plate 94 and penetrates into capacitor 92 while capacitor 92 is electrically charged, capacitor 92 will short circuit and rupture in the manner described above with respect to capacitor 36. This, in turn, will drive flyer plate 94 in an outboard direction, across the path of the penetrating ordnance thereby dissipating its energy. In some examples of embodiments 91, flyer plate 94 may have a thickness that substantially exceeds the thickness of outer flyer plate 34. Such additional thickness could compensate for the absence of a second flyer plate, or include the features of passive armor 88.

Figure 12:
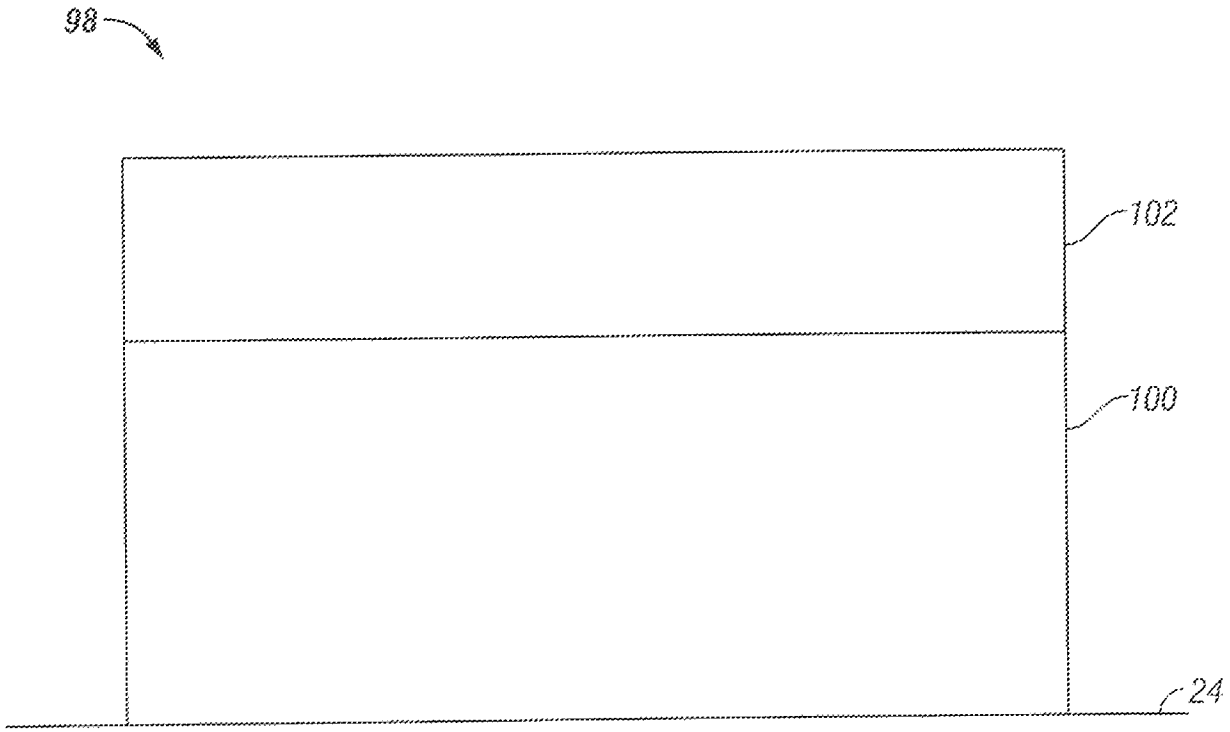
FIG. 12 is a schematic side view illustrating another alternate embodiment of a capacitive reactive armor assembly made in accordance with the teachings of the present disclosure.

FIG. 12 is a schematic cross-sectional view illustrating an alternate embodiment 98 of a capacitive reactive armor assembly made in accordance with the teachings of the present disclosure. Alternate embodiment 98 includes a capacitor 100 and a flyer plate 102. With continuing reference to FIGS. 1-11, capacitor 100 is substantially identical to capacitor 96, and flyer plate 102 is substantially identical to outer flyer plate 94.

Alternate embodiment 98 differs from alternate embodiment 91 primarily in that alternate embodiment omits any housing in which to mount capacitor 100 and flyer plate 102 whereas alternate embodiment 91 utilizes a housing. Accordingly, alternate embodiment 98 may be configured to be mounted directly to a lateral side 24 of tank 20 (or to any other outer surface of the hull of tank 20). Because alternate embodiment 98 is positioned directly adjacent to lateral side 24, when alternate embodiment 98 is penetrated and ruptures, lateral side 24 obstructs movement of capacitor 100 in the inboard direction and, accordingly, substantially all of the energy of the rupture of capacitor 100 is directed in an outboard direction.

Figure 13:
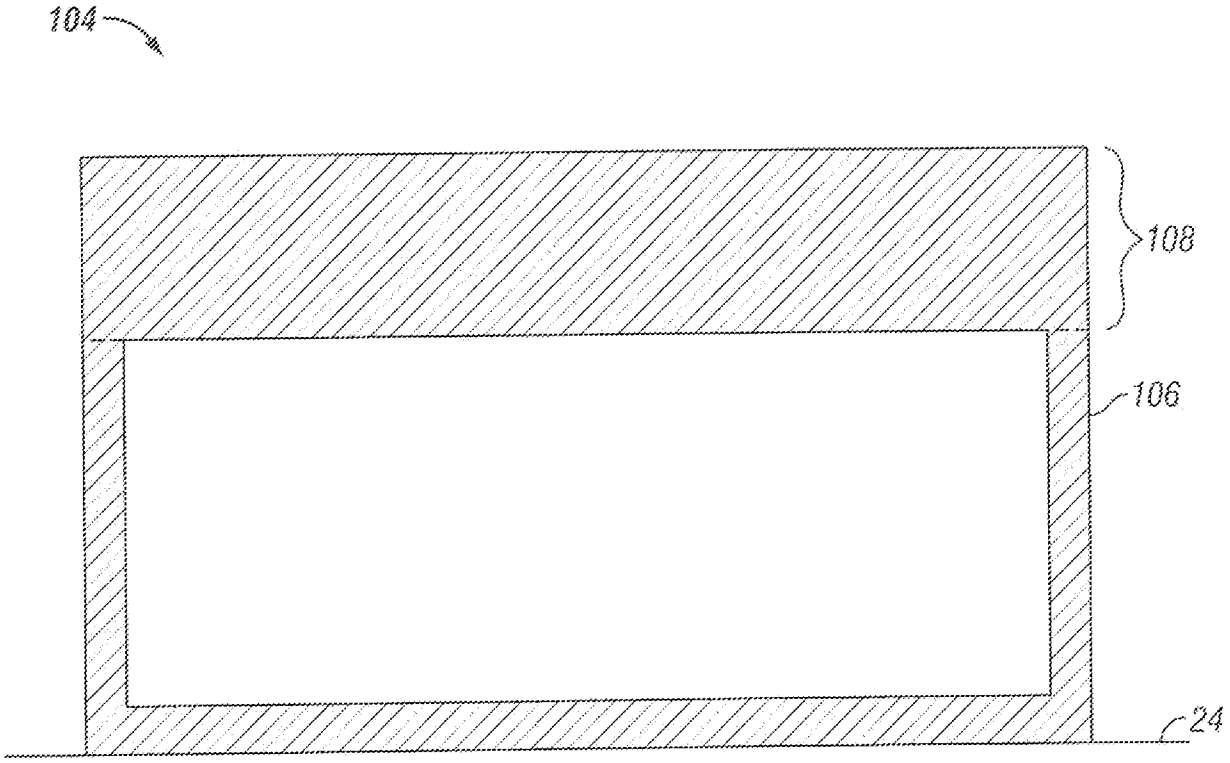
FIG. 13 is a schematic side view illustrating yet another alternate embodiment of a capacitive reactive armor assembly made in accordance with the teachings of the present disclosure.

FIG. 13 is a schematic cross-sectional view illustrating yet another alternate embodiment 104 of a capacitive reactive armor assembly made in accordance with the teachings of the present disclosure. Alternate embodiment 104 includes a capacitor 106 and a flyer plate 108. With continuing reference to FIGS. 1-12, alternate embodiment 104 differs from alternate embodiment 98 primarily in that alternate embodiment 104 integrates flyer plate 108 into an outer skin of capacitor 106 whereas alternate embodiment 98 includes the capacitor and the flyer plate as two separate components.

The configuration illustrated in FIG. 13 further reduces the number of components necessary to complete construction of alternate embodiment 104, thereby further simplifying its manufacture and further reducing its cost. In some examples of alternate embodiment 104, portions of the skin of capacitor 106 may include thinned or weakened or portions to facilitate separation of flyer plate 108 from capacitor 106 when capacitor 106 ruptures.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A capacitive reactive armor assembly for shielding a vehicle, the capacitive reactive armor assembly comprising:

a first flyer plate;

a second flyer plate; and a capacitor positioned between the first flyer plate and the second flyer plate, the capacitor configured to store an electric charge and to explosively rupture when the capacitor is penetrated while the capacitor is electrically charged, wherein the first flyer plate is disposed immediately adjacent a first side of the capacitor, wherein the second flyer plate is disposed immediately adjacent a second side of the capacitor, wherein the first flyer plate, the second flyer plate, and the capacitor each having a periphery that is substantially similar such that when sandwiched together, the first flyer plate, the second flyer plate, and the capacitor form an assembly having a predetermined three dimensional configuration, and wherein the capacitive reactive armor further comprises a housing adapted to be attached to the vehicle, the housing being configured to receive the first flyer plate, the second flyer plate, and the capacitor, the housing having a periphery substantially similar to the periphery of the three dimensional configuration, the three dimensional configuration being supported within the housing by a connection between the housing and the capacitor.

2. The capacitive reactive armor assembly of claim 1, wherein the capacitor is further configured to propel the first flyer plate and the second flyer plate across a path of a penetrating projectile when the capacitor explosively ruptures.

3. The capacitive reactive armor assembly of claim 1, wherein the first flyer plate and the second flyer plate are integral with the capacitor.

4. The capacitive reactive armor assembly of claim 1, wherein the predetermined three dimensional configuration may be rectangular, circular, irregular shaped or conformal to an irregular or curved surface.

5. The capacitive reactive armor assembly of claim 1, wherein the capacitor comprises a plurality of materials having a tendency to be highly reactive with one another, thereby enhancing an explosive force of the capacitor when the capacitor explodes.

6. The capacitive reactive armor assembly of claim 5, wherein the materials comprise aluminum, zirconium, magnesium, plastics, reactive electrolytes or combinations thereof.

7. The capacitive reactive armor assembly of claim 1, wherein the capacitor is configured to refrain from explosively rupturing while the capacitor is not electrically charged.

8. The capacitive reactive armor assembly of claim 1, wherein the housing is further configured to support the first flyer plate, the second flyer plate, and the capacitor at a position that is spaced apart from the vehicle.

9. The capacitive reactive armor of claim 1, wherein the connection between the housing and the capacitor is disposed at an approximate center of the capacitor.

10. A capacitive reactive armor assembly for shielding a vehicle, the capacitive reactive armor assembly comprising:

a first flyer plate;

a second flyer plate;

a capacitor positioned between the first flyer plate and the second flyer plate, the capacitor configured to store an electric charge and to explosively rupture when the capacitor is penetrated while the capacitor is electrically charged; and a passive armor body disposed proximate the first flyer plate, wherein the first flyer plate is disposed immediately adjacent a first side of the capacitor, wherein the second flyer plate is disposed immediately adjacent a second side of the capacitor, wherein the first flyer plate, the second flyer plate, and the capacitor each having a periphery that is substantially similar such that when sandwiched together, the first flyer plate, the second flyer plate, and the capacitor form an assembly having a predetermined three dimensional configuration, and wherein the capacitive reactive armor further comprises a housing adapted to be attached to the vehicle, the housing being configured to receive the first flyer plate, the second flyer plate, and the capacitor, the housing having a periphery substantially similar to the periphery of the three dimensional configuration, the three dimensional configuration being supported within the housing by a connection between the housing and the capacitor.

11. The capacitive reactive armor assembly of claim 10, wherein the capacitor is further configured to propel the first flyer plate and the second flyer plate across a path of a penetrating projectile when the capacitor explosively ruptures.

12. The capacitive reactive armor assembly of claim 10, wherein the passive armor body is configured to shield the first flyer plate and the capacitor from a projectile other than an armor penetrating projectile.

13. The capacitive reactive armor assembly of claim 10, wherein the passive armor body is disposed adjacent the first flyer plate.

14. The capacitive reactive armor assembly of claim 10, wherein the passive armor body is spaced apart from the first flyer plate.

15. The capacitive reactive armor assembly of claim 10, wherein the passive armor body comprises a metal material.

16. The capacitive reactive armor assembly of claim 10, wherein the passive armor body comprises a composite material of fabric and polymer or elastomeric resins.

17. The capacitive reactive armor assembly of claim 10, wherein the passive armor body comprises a ceramic material.

18. The reactive armor assembly of claim 10, wherein the passive armor body comprises a combination one of more materials of metal, ceramic, or composite.

19. A capacitive reactive armor assembly for shielding a vehicle, the capacitive reactive armor assembly comprising:

a first flyer plate;

a second flyer plate;

a capacitor positioned between the first flyer plate and the second flyer plate such that the first flyer plate and the second flyer plate are adjacent to the capacitor, the capacitor configured to store an electric charge, to explosively rupture when the capacitor is penetrated while the capacitor is electrically charged, and to propel the first flyer plate and the second flyer plate across a path of a penetrating projectile when the capacitor explosively ruptures;

a passive armor body disposed proximate the first flyer plate; and a housing adapted to be attached to the vehicle, the housing configured to receive the first flyer plate, the second flyer plate, and the capacitor, to attach the first flyer plate, the second flyer plate and the capacitor to the vehicle, and to support the first flyer plate, the second flyer plate, and the capacitor at a position that is spaced apart from the vehicle, wherein the first flyer plate is disposed immediately adjacent a first side of the capacitor, wherein the second flyer plate is disposed immediately adjacent a second side of the capacitor, wherein the first flyer plate, the second flyer plate, and the capacitor each having a periphery that is substantially similar such that when sandwiched together, the first flyer plate, the second flyer plate, and the capacitor form an assembly having a predetermined three dimensional configuration, and wherein the housing has a periphery substantially similar to the periphery of the three dimensional configuration, the three dimensional configuration being supported within the housing by a connection between the housing and the capacitor.

20. A capacitive reactive armor assembly for shielding a vehicle, the reactive armor assembly comprising:

a flyer plate; and a capacitor positioned between the flyer plate and a hull of the vehicle, the capacitor configured to store an electric charge and to explosively rupture when the capacitor is penetrated while the capacitor is electrically charged, wherein the flyer plate is disposed immediately adjacent a side of the capacitor, wherein the flyer plate and the capacitor each having a periphery that is substantially similar such that when sandwiched together, the flyer plate and the capacitor form an assembly having a predetermined three dimensional configuration, and wherein the capacitive reactive armor further comprises a housing adapted to be attached to the vehicle, the housing being configured to receive the flyer plate and the capacitor, the housing having a periphery substantially similar to the periphery of the three dimensional configuration, the three dimensional configuration being supported within the housing by a connection between the housing and the capacitor.

21. The capacitive reactive armor assembly of claim 20, wherein the capacitor is further configured to propel the flyer plate across the path of a penetrating projectile when the capacitor explosively ruptures.

22. The capacitive reactive armor assembly of claim 20, wherein the flyer plate is disposed adjacent to the capacitor and the capacitor is disposed adjacent to the hull.

23. The capacitive reactive armor assembly of claim 20, wherein the flyer plate is integral with the capacitor.

24. The capacitive reactive armor assembly of claim 20, wherein the flyer plate and the capacitor are each configured such that when assembled together, they form an assembly having a three dimensional configuration that may be rectangular, circular, irregular shaped, or conformal to an irregular or curved surface.

25. The capacitive reactive armor assembly of claim 20, wherein the capacitor comprises materials having a tendency to be reactive with one another and the environment, thereby enhancing an explosive force of the capacitor when the capacitor short circuits.

26. The capacitive reactive armor assembly of claim 20, wherein the capacitor is constructed with internal layering configured to direct the explosive energy outward to propel flyer plates at higher velocity.

27. The capacitive reactive armor assembly of claim 20, wherein the capacitor is constructed with a housing configured to direct an explosive energy in an outward direction, thereby propelling the flyer plate at a high velocity when the capacitor ruptures.

28. The capacitive reactive armor assembly of claim 20, wherein the capacitor is constructed with a housing having an outer wall of sufficient thickness or composition to resist the penetration of small arms bullets.

29. The capacitive reactive armor assembly of claim 20, wherein the capacitor is constructed with a housing configured to resist penetration by directed energy weapons.

30. The capacitive reactive armor assembly of claim 20, constructed with a housing configured to resist damage by blast pressures.

* * * * *